US005967908A

United States Patent [19]

Yamagishi et al.

[11] Patent Number: 5,967,908

[45] Date of Patent: Oct. 19, 1999

[54] GOLF BALL

[75] Inventors: Hisashi Yamagishi; Hiroshi Higuchi; Yasushi Ichikawa; Junji Hayashi, all of Chichibu, Japan

[73] Assignee: Bridgestone Sports Co., Ltd., Tokyo, Japan

[21] Appl. No.: 09/069,280

[22] Filed: Apr. 29, 1998

[30] Foreign Application Priority Data

May 9, 1997 [JP] Japan ..... 9-136101

[51] Int. Cl.[6] ..... A63B 37/06; A63B 37/12; A63B 37/14

[52] U.S. Cl. ..... 473/373; 473/374; 473/384

[58] Field of Search ..... 473/373, 374, 473/375, 376, 378, 383, 384

[56] References Cited

U.S. PATENT DOCUMENTS 5,779,562 7/1998 Melvin et al. ..... 473/374 X 5,779,563 7/1998 Yamagishi et al. ..... 473/384 X 5,820,487 10/1998 Nakamura et al. ..... 473/374

5,820,492 10/1998 Yamagishi et al. ..... 473/384 X

*Primary Examiner*—George J. Marlo

*Attorney, Agent, or Firm*—Sughrue, Mion, Zinn, Macpeak & Seas, PLLC

[57] ABSTRACT

A golf ball includes a solid core, an intermediate layer, and a cover having dimples formed therein. The core has a Shore D hardness at the surface of 30–48, the intermediate layer has a Shore D hardness of 53–60, and the cover has a higher Shore D hardness of 55–65. In the cover, 370 to 450 dimples of at least two types having different diameters and/or depths are distributed so as to cover at least 63% of the ball surface. The index Dst of the overall dimple surface area is at least 4. The golf ball provides significantly improved flight distance and a good feel by virtue of a good balance in hardness and optimized dimple characteristics.

3 Claims, 3 Drawing Sheets

GOLF BALL

BACKGROUND OF THE INVENTION

1. Field of the Invention

The present invention relates to a golf ball comprising a solid core, an intermediate layer, and a cover having a multiplicity of dimples formed on its surface. More particularly, the invention relates to a golf ball having an optimum balance in hardness between the core, the intermediate layer and the cover, and having suitable dimple characteristics, thus presenting both a good feel when hit with a club and improved flight performance regardless of the club head speed.

2. Prior Art

With the rise in the golfing population in recent years, the attributes that golfers look for in a golf ball have become more diverse and individualized. The desire is especially strong for golf balls having greater flight distance and a better feel. This has led to numerous investigations on ball construction, dimple parameters and so forth.

For instance, golf balls having a variety of constructions are available today on the market, but the majority of commercial golf balls are either two-piece solid golf balls made of a rubber-based core and a cover composed of ionomer resin or the like, or thread-wound golf balls composed of a thread-wound core obtained by winding rubber thread about a solid or liquid center, and a cover formed over the core.

Most golfers of ordinary skill use two-piece golf balls because of their excellent flight performance and durability. However, these balls have a very hard feel, in addition to which the rapid separation of the ball from the head of the club results in poor control. For this reason, many professional golfers and skilled amateurs prefer using thread-wound balls to two-piece solid balls. Yet, although thread-wound golf balls have a superior feel and control, their distance and durability fall short of those for two-piece balls.

Thus, two-piece golf balls and thread-wound golf balls today provide mutually opposing features, and so golfers select which type of ball to use based on their level of skill and personal preference.

This situation has prompted efforts to achieve the feel of a thread-wound ball in a solid golf ball, as a result of which a number of soft two-piece solid golf balls have been proposed. A soft core is used to obtain such soft two-piece balls, but making the core softer lowers the resilience of the golf ball and compromises flight performance and durability. As a result, not only do these balls lack the excellent flight performance and durability characteristic of ordinary two-piece solid golf balls, they are often in fact unfit for actual use.

Furthermore, these golf balls have generally been made to serve the needs of high head speed players, such as the professional golfer and the skilled amateur golfer. When they are used by low head speed players such as beginners, seniors and ladies, they are unsatisfactory both in terms of distance and feel.

Numerous studies have also been done on dimple characteristics, such as the dimple shape (e.g., depth and diameter), dimple configuration, and various dimple parameters, but there remains considerable room for improvement. The increasingly diverse and individualized desires of golfers have yet to be fully met.

SUMMARY OF THE INVENTION

An object of the present invention is to provide a golf ball comprising a solid core, an intermediate layer, and a cover having a multiplicity of dimples, which golf ball is well balanced in hardness between the core, the intermediate layer and the cover, and given appropriate dimple characteristics, thus improving both the feel of the ball when hit with a club and the flight performance regardless of the club head speed.

We have found that, in a golf ball comprising a solid core, an intermediate layer, and a cover on the surface of which are formed a multiplicity of dimples, the flight distance and feel of the ball can be increased, regardless of the club head speed, by optimizing the ball construction, especially the balance in hardness between the core, the intermediate layer and the cover, and by also providing suitable dimple characteristics, particularly the total number of dimples, the dimple surface coverage, and the index Dst of the overall dimple surface area.

More specifically, we have discovered that, in a golf ball comprising a solid core, an intermediate layer, and a cover on the surface of which are formed a multiplicity of dimples, a ball construction having an optimal balance in hardness is obtained by providing the core with a Shore D hardness at the surface of up to 48, the intermediate layer with a Shore D hardness that is 53 to 60 and at least 8 Shore units higher than the surface hardness of the core, and the cover with a Shore D hardness that is 55 to 65 and higher than the hardness of the intermediate layer. Moreover, suitable dimple characteristics are obtained by forming, on the surface of a golf ball having the above-described construction, at least two types of dimples of different diameters and/or depths, by setting the total number of these dimples at 370 to 450, the ratio of the ball surface occupied by the dimples at 63% or more, and the index Dst of the overall dimple surface area at 4 or more, and also by setting the coefficient $V_0$ of the dimple cross-sectional shape at 0.37 to 0.55. These dimple characteristics, in combination with the optimized ball construction described above, provide a golf ball having a significantly improved flight distance and a good feel, regardless of the club head speed.

Accordingly, the present invention provides a golf ball comprising a solid core, an intermediate layer, and a cover on the surface of which are formed a plurality of dimples, wherein the core has a Shore D hardness at the surface of up to 48, the intermediate layer has a Shore D hardness of 53 to 60 which is at least 8 Shore units higher than the surface hardness of the core, the cover has a Shore D hardness of 55 to 65 which is higher than the hardness of the intermediate layer. The dimples are of at least two types having different diameters and/or depths, the total number of dimples is 370 to 450, the dimples cover at least 63% of the ball surface, and the index Dst of the overall dimple surface area is at least 4. Preferably, the coefficient $V_0$ of the dimple cross-sectional shape in this golf ball is 0.37 to 0.55, and the cover of the golf ball is made of a thermoplastic resin composed primarily of an ionomer resin.

DETAILED DESCRIPTION OF THE INVENTION

Figure 1:
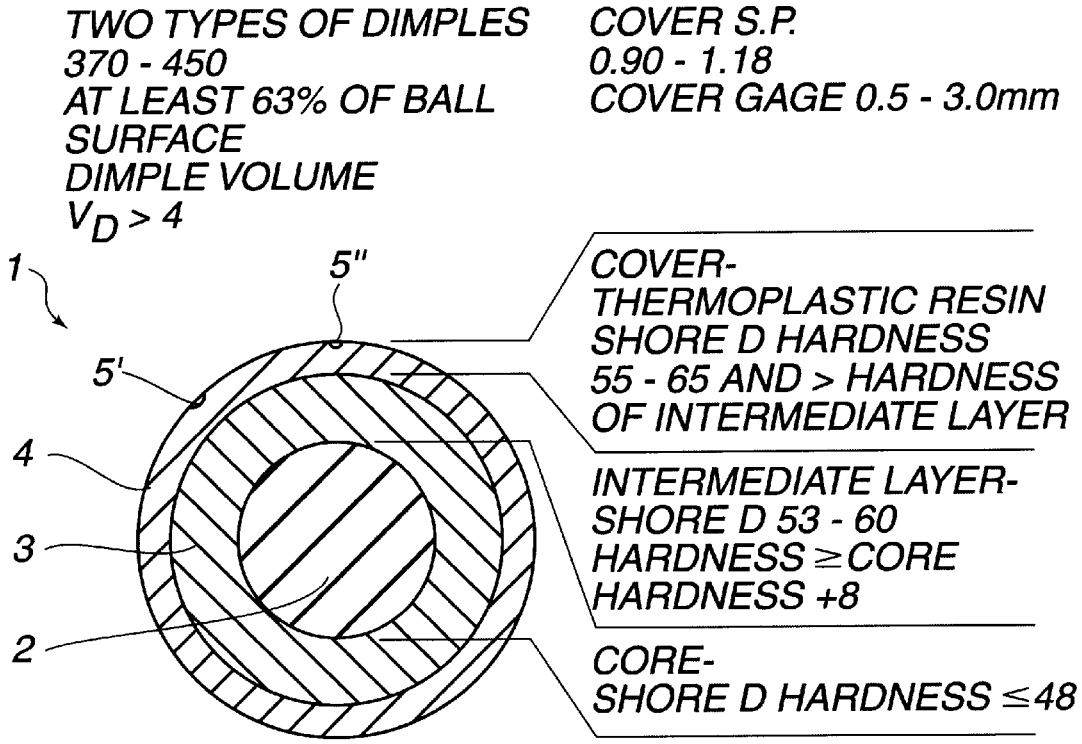
FIG. 1 is a schematic cross-sectional view of a golf ball according to one embodiment of the invention.

Referring to FIG. 1, a golf ball 1 according to the present invention is shown as comprising a solid core 2 which is formed soft, an intermediate layer 3 which is harder than the surface of the core 2, and a cover 4 which is harder than the intermediate layer 3. A multiplicity of dimples (not shown) are formed on the surface of the cover 4.

The solid core has a surface hardness, as measured with a Shore D durometer, of up to 48, and preferably up to 45, but at least 30. A surface hardness greater than 48 gives too hard a core, which results in a ball having a short flight distance and a hard feel, particularly when driven by a low head speed golfer. The surface hardness of the solid core here refers to the average value for measurements taken at five points on the spherical surface of the solid core.

The diameter, specific gravity, and weight of the core are suitably adjusted insofar as the objects of the invention are attainable. Thus, the core preferably has a diameter of 30 to 39 mm, and especially 33 to 38 mm; a specific gravity of 1.10 and 1.30, and especially 1.13 to 1.25; and a weight of 25 to 35 g, and especially 26 to 33 g.

In the practice of the invention, no particular limit is imposed on the composition from which the solid core is formed. The solid core may be formed using a base rubber, a crosslinking agent, a co-crosslinking agent, an inert filler and other substances employed in the formation of conventional solid cores. The base rubber used herein may be any natural rubber and/or synthetic rubber conventionally used in solid golf balls, although 1,4-cis polybutadiene containing at least 40% cis structure is especially preferable in the invention. The polybutadiene may be blended with a suitable amount of natural rubber, polyisoprene rubber, styrene-butadiene rubber or the like if desired. Examples of crosslinking agents that can be used in the core-forming composition include organic peroxides such as dicumyl peroxide and di-t-butyl peroxide. The crosslinking agent is generally added in an amount of about 0.5 to 1.8 parts by weight per 100 parts by weight of the base rubber. Co-crosslinking agents that can be used include, without particular limitation, the metal salts of unsaturated fatty acids, and preferably the zinc and magnesium salts of unsaturated fatty acids having 3 to 8 carbons (e.g., acrylic acid and methacrylic acid), of which zinc acrylate is especially preferable. The amount of co-crosslinking agent added may be set as appropriate, although this amount is generally about 15 to 40 parts by weight per 100 parts by weight of the base rubber. Suitable inert fillers include zinc oxide, barium sulfate, silica, calcium carbonate and zinc carbonate, with zinc oxide and barium sulfate being most often used. The filler is usually included in an amount of up to 40 parts by weight per 100 parts by weight of the base rubber, although this amount is governed in part by the specific gravities of the core and the cover, as well as weight standards for the ball, and is not subject to any particular limits. The overall hardness and weight of the core in the present invention may be set at optimum values by suitably adjusting the proportions in which the crosslinking agent and the filler (typically zinc oxide or barium sulfate) are added.

The core-forming composition obtained by combining the above components may be worked in a conventional mixer such as a Banbury mixer or a roll mill, then formed into a solid core of the above-indicated hardness using a core mold.

The intermediate layer 3 enclosing the core 2 has a Shore D hardness of 53 to 60, and preferably 54 to 59. A hardness of less than 53 fails to provide sufficient resilience, whereas a hardness of more than 60 results in a poor feel. The intermediate layer is formed to a Shore D hardness at least 8 units higher, and preferably 9 to 30 units higher, than the surface hardness of the core. A hardness difference of less than 8 units results in a golf ball having a poor feel and insufficient resilience.

The gage and specific gravity of the intermediate layer may be suitably adjusted insofar as the objects of the invention are attainable. Preferably, the gage (radial thickness) is 0.5 to 2.5 mm, and especially 1.0 to 2.3 mm; and the specific gravity is 0.90 to 1.18, and especially 0.91 to 1.16. The intermediate layer is not limited to one layer only, and may be formed as a plurality of layers.

Because the intermediate layer 3 serves to compensate for a loss of resilience in the core which is formed soft, it is preferably made of a material having, within the above-indicated range in hardness, an excellent resilience, typically an ionomer resin such as Himilan (manufactured by DuPont-Mitsui Polychemicals Co., Ltd.) or Surlyn (E. I. du Pont de Nemours & Co., Inc.). Thermoplastic resins other than ionomer resins which can be used in the intermediate layer include maleic anhydride-modified ethylene-alkyl unsaturated carboxylic acid ester copolymers such as HPR AR201 (DuPont-Mitsui Polychemicals Co., Ltd.), ethylene-unsaturated carboxylic acid-alkyl unsaturated carboxylic acid ester terpolymers such as Nucrel AN 4311 and AN 4307 (DuPont-Mitsui Polychemicals Co., Ltd.), polyester elastomers such as Hytrel 4047 (DuPont-Toray Co., Ltd.), polyamide elastomers such as Pebax 3533 (Atochem Inc.), and thermoplastic elastomers with crystalline polyethylene blocks such as Dynaron E6100P and E4600P (Japan Synthetic Rubber Co., Ltd.). These may be used alone or as mixtures of two or more thereof. Preferred compositions for the intermediate layer are obtained by blending 10 to 100% by weight, and especially 30 to 95% by weight, of the ionomer resin with 0 to 90% by weight, and especially 5 to 70% by weight, of a thermoplastic resin other than the ionomer resin.

In the resin composition for the intermediate layer, additives may be also incorporated which include inert fillers, typically zinc oxide or barium sulfate, as weight modifiers, and titanium dioxide for the purpose of coloration.

Any suitable method may be employed to cover the core 2 with this intermediate layer 3. For example, the intermediate layer may be formed about the core by surrounding the core with two hemispherical half-cups preformed from the intermediate layer composition and molding under applied heat and pressure, or by injection-molding the intermediate layer composition around the core.

The cover 4 enclosing the intermediate layer 3 is formed to a greater hardness than the intermediate layer. This must have a Shore D hardness of 55 to 65, and preferably 56 to 63. A cover having a hardness less than 55 fails to provide the golf ball with sufficient resilience, whereas a hardness higher than 65 results in a poor feel and poor control. The difference in Shore D hardness between the cover and the intermediate layer is preferably 1 to 10 units, and more preferably 2 to 8 units. A cover hardness lower than the hardness of the intermediate layer does not provide the ball with sufficient resilience and results in a poor feel.

The gage and specific gravity of the cover may be suitably adjusted insofar as the objects of the present invention are attainable. Preferably, the gage is 0.5 to 3.0 mm, and especially 1.0 to 2.3 mm, and the specific gravity is 0.90 to 1.18, and especially 0.91 to 1.15. Moreover, the cover is not limited to one layer only, and may be formed as two or more layers.

No limits are imposed on the cover composition. The cover may be formed of any well-known material having suitable properties as golf ball cover stock, although the use of a thermoplastic resin composed primarily of ionomer resin is preferable. Examples include Himilan 1557, 1605, 1855 and 1856 (DuPont-Mitsui Polychemicals Co., Ltd.). These may be used alone or as mixtures of two or more thereof.

UV absorbers, antioxidants, and dispersing aids such as metallic soaps may be added to the cover composition if necessary. Any suitable method may be employed to apply the cover over the intermediate layer, although this is generally done by surrounding the intermediate layer with two hemispherical cups preformed from the cover composition and molding under applied heat and pressure, or by injection-molding the cover composition around the intermediate layer.

As with conventional golf balls, the golf ball obtained in the above-described manner has a multiplicity of dimples formed on the surface. These dimples are of at least two types, and preferably of two to six types, having different diameters and/or depths. Preferably, the dimples have a diameter of 2.0 to 5.0 mm, and especially 2.2 to 4.5 mm, and a depth of 0.10 to 0.28 mm, and especially 0.11 to 0.25 mm. The total number of dimples is 370 to 450, and preferably 380 to 440. Dimples having a planar shape that is circular are preferred, although circularity is not critical and the dimples may also have elliptical, oval, petaloid, polygonal or other non-circular shapes.

In the golf ball of the invention, if one thinks of the ball as a sphere having an imaginary spherical surface, the ratio of the surface area of this imaginary sphere delimited by the edges of the individual dimples to the entire surface area of the imaginary sphere, sometimes referred to herein as the dimple surface coverage, is at least 63% of the surface of the ball, and preferably 65 to 79%. A dimple surface coverage of less than 63% fails to provide the golf ball with a sufficient flight distance.

The dimples in the invention are formed such that the dimple cross-sectional shape coefficient $V_0$, which is understood here to be the average value obtained for all the dimples when the volume of space in a dimple below a planar surface circumscribed by the edge of the dimple is divided by the volume of a cylinder whose base is the planar surface and whose height is the maximum depth of that particular dimple from this base, is 0.37 to 0.55, and preferably 0.39 to 0.53.

Figure 2:
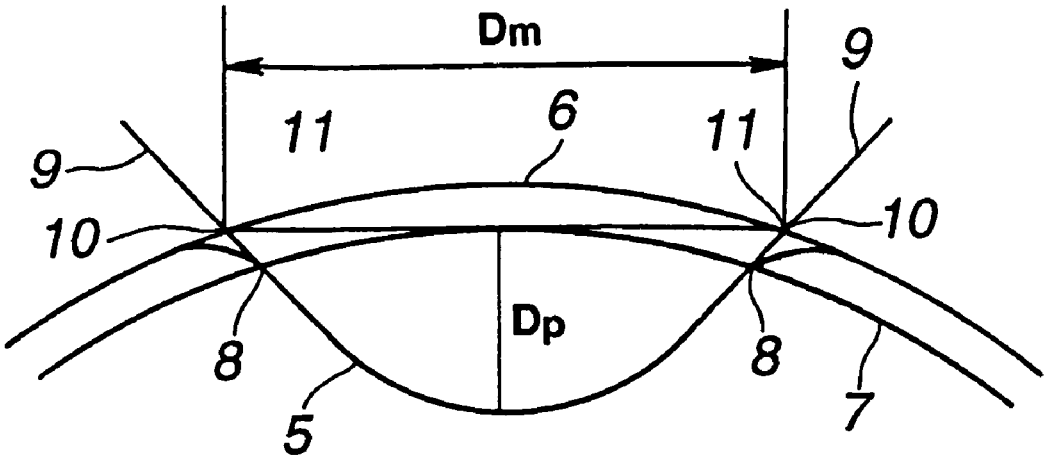
FIG. 2 is schematic cross-sectional view of a dimple illustrating how to calculate $V_0$.
Figure 3:
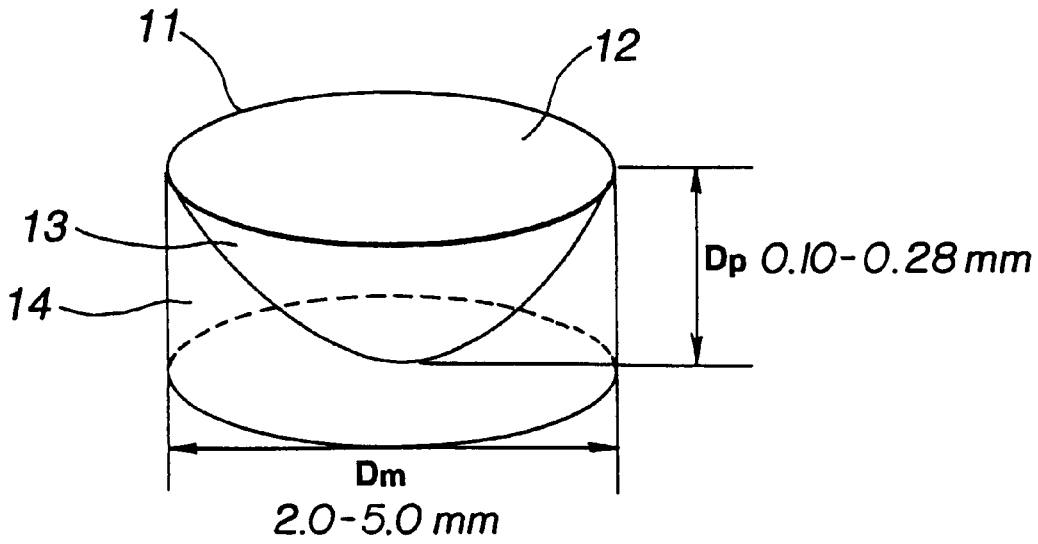
FIG. 3 is a perspective view of the same dimple.
Figure 4:
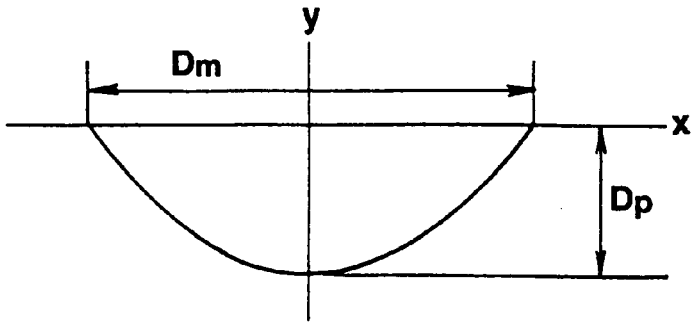
FIG. 4 is a cross-sectional view of the same dimple.

The value $V_0$ indicates the proportion of the volume that individual dimples essentially occupy on the golf ball. This value is described in greater detail. Reference is made first to cases in which the planar shape of the dimple is circular. In the cross-section of FIG. 2, viewed radially with respect to the ball center, an imaginary sphere 6 having the diameter of the ball and an imaginary sphere 7 having a diameter 0.16 mm smaller than the ball diameter are drawn in conjunction with a dimple 5. The circumference of sphere 7 intersects the dimple 5 at two points 8. The tangents 9 to the dimple 5 at these points 8, extended outward, intersect imaginary sphere 6 at points 10. A series of such intersections 10 defines the dimple edge. The dimple edge is so defined for the reason that the exact position of the dimple edge cannot be otherwise determined because the actual edge of a dimple 5 is generally rounded. As shown in FIGS. 3 and 4, the dimple edge 11 circumscribes a planar surface 12 (a circle having a diameter $D_m$). The dimple space 13 below this planar surface 12 has a volume $V_P$ which is calculated using the equation shown below. A cylinder 14 whose base is the planar surface 12 and whose height is the maximum depth $D_P$ of the dimple from this planar surface 12 or base has a volume $V_Q$ which is calculated using the equation shown below. The $V_0$ value is obtained by calculating the ratio of the dimple space volume $V_P$ to the cylinder volume $V_Q$, and determining the average of this ratio for all the dimples on the ball surface.

$$V_P = \int_0^{\frac{Dm}{2}} 2\pi xy dx$$

$$V_Q = \frac{\pi Dm^2 Dp}{4}$$

$$V_0 = \frac{V_p}{V_Q}$$

In cases where the planar shape of the dimple is not circular, the maximum diameter of the dimple (or the maximum length of the planar surface) is determined, and the planar surface of the dimple is assumed to be a circle having a diameter equal to this maximum diameter (or maximum length), whereupon $V_0$ can be calculated as above. Where a plurality of dimple types having different diameters and/or depths are formed on the golf ball, $V_0$ is determined for each type of dimple, and these values are averaged to give the coefficient $V_0$ of the dimple cross-sectional shape for the entire ball.

Also, letting n be the number of types of dimples formed on the ball surface, and $D_{mk}$, $D_{pk}$ and Nk (where k=1,2,3, . . . n) be respectively the diameter, maximum depth and number of each type of dimple, the golf balls of the invention are preferably formed such that the index Dst of the overall dimple surface area, as given by the equation shown below, is at least 4.0, and preferably 4.2 to 10.0. This index Dst optimizes the various dimple parameters. When the index Dst is less than 4.0, the synergistic effect due to optimal ball construction and optimized dimple parameters that is the aim of this invention fails to be achieved, resulting in a poor flight performance.

$$Dst = \frac{n\sum_{k-1}^{n}[(D_{mk}^2 + D_{pk}^2) \times V_0 k \times Nk]}{4R^2}$$

Note that R in the formula is the radius of the golf ball, $V_0$ is as defined above, and Nk is the number of dimples k.

Thus, by optimizing the ball construction, and especially the balance in hardness between the core, the intermediate layer and the cover, and by also optimizing the parameters of the dimples formed on the surface of a ball with this type of construction, and in particular the overall number of dimples, the dimple surface coverage and the index Dst of overall dimple surface area, the present invention provides a golf ball having a significantly improved flight distance and an excellent feel upon impact, regardless of the head speed of the club with which the ball is hit.

EXAMPLES

Examples of the invention are given below by way of illustration, and are not intended to limit the scope of the invention.

Examples 1–4 and Comparative Examples 1–5

Solid cores (a) to (f) were prepared by kneading the core compositions shown in Table 1, then vulcanizing the kneaded compositions within a mold at 155° C. for about 20 minutes. The surface hardness of a core is the average of five values measured at random points on the core surface with a Shore D durometer.

Next, using materials A to H in Table 2 for the intermediate layer and the cover, first the intermediate layer was injection-molded onto the surface of the core, then the cover was injection-molded around this intermediate layer. This was done in accordance with the core, intermediate layer and cover combinations shown in Table 4. Dimples as specified in Table 3 were formed on the surface of the cover at this time. The properties and performance of the golf balls thus obtained in Examples 1 to 4 and Comparatives Examples 1 to 5 are shown in Table 4. The results for distance and feel shown in Table 4 were determined by the methods described below. The finished balls all had a weight of 45.20±0.20 g and a diameter of 42.70±0.05 mm.

Distance

Using a swing robot manufactured by True Temper Co., the golf balls were measured for carry and total distance when hit with a driver (#W1) at head speeds of 45 m/s (HS 45) and 35 m/s (HS 35). The driver used at HS45 was a PRO 230 Titan having a loft angle of 10°, while that used at HS35 was a PRO 230 Titan LD having a loft angle of 13° (both manufactured by Bridgestone Sports Co., Ltd.).

Feel

The balls were driven by three golfers with a head speed of 45 m/s (45 HS) and three golfers with a head speed of 35 m/s (35 HS), who then rated each ball according to the following criteria.

S: soft

RS: rather soft

RH: rather hard

H: hard

TABLE 1

| Core formulation (parts by weight) | a | b | c | d | e | f |
|---|---|---|---|---|---|---|
| cis-1,4-Polybutadiene | 100 | 100 | 100 | 100 | 100 | 100 |
| Zinc acrylate | 25 | 21.5 | 19.5 | 18.5 | 34 | 41 |
| Dicumyl peroxide | 0.6 | 0.6 | 0.6 | 0.6 | 0.6 | 0.6 |
| Peptizer | 1 | 1 | 1 | 1 | 1 | 1 |
| Antioxidant | 0.1 | 0.1 | 0.1 | 0.1 | 0.1 | 0.1 |
| Zinc oxide | 29.7 | 31 | 31.8 | 34.5 | 26.3 | 23.7 |

TABLE 2

| Intermediate layer and cover material (parts by weight) | A | B | C | D | E | F | G | H |
|---|---|---|---|---|---|---|---|---|
| Himilan 1557*1 | | | | | | 50 | | |
| Himilan 1605*1 | 35 | | 42 | | | 50 | | 50 |
| Himilan 1650*1 | | | | | | | 75 | |
| Himilan 1706*1 | 35 | | 42 | | | | 25 | 50 |
| Himilan 1855*1 | | | | | 50 | | | |
| Himilan 1856*1 | | | | | 50 | | | |
| Himilan AM7311*1 | | | | 37 | | | | |
| Surlyn 7930*2 | | | | 37 | | | | |
| Surlyn 8511*2 | | 35 | | | | | | |
| Surlyn 8512*2 | | 35 | | | | | | |
| Dynaron E6100P*3 | | 30 | 16 | | | | | |
| Dynaron E4600P*3 | 30 | | | | | | | |
| Nucrel AN4311*4 | | | | 26 | | | | |

*1An ionomer resin manufactured by DuPont Mitsui Polychemicals Co., Ltd.

*2An ionomer resin manufactured by E.I. du Pont de Nemours & Co., Inc.

*3A hydrogenated polybutadiene block copolymer of E-EB-E system manufactured by Japan Synthetic Rubber Co., Ltd.

*4An ethylene-methacrylic acid-acrylate terpolymer manufactured by Dupont-Mitsui Polychemicals Co., Ltd.

TABLE 3

| Type of dimple | Diameter (mm) | Depth (mm) | $V_0$ | Number | Total number | Surface coverage (%) | Dst |
|---|---|---|---|---|---|---|---|
| I | 4.00 | 0.175 | 0.51 | 276 | 396 | 76.5 | 6.3 |
| | 3.60 | 0.150 | 0.51 | 24 | | | |
| | 3.25 | 0.140 | 0.51 | 60 | | | |
| | 2.45 | 0.125 | 0.51 | 36 | | | |
| II | 3.80 | 0.175 | 0.52 | 264 | 432 | 72.8 | 4.5 |
| | 3.20 | 0.150 | 0.49 | 120 | | | |
| | 2.35 | 0.125 | 0.48 | 48 | | | |
| III | 4.10 | 0.185 | 0.48 | 72 | 392 | 78.5 | 4.5 |
| | 3.90 | 0.175 | 0.48 | 200 | | | |
| | 3.50 | 0.155 | 0.48 | 120 | | | |
| IV | 3.40 | 0.195 | 0.49 | 360 | 500 | 68.6 | 2.7 |
| | 2.45 | 0.195 | 0.49 | 140 | | | |
| V | 3.95 | 0.240 | 0.40 | 240 | 360 | 67.2 | 2.2 |
| | 3.10 | 0.240 | 0.40 | 120 | | | |

TABLE 4

| | | Examples | | | | Comparative Examples | | | | |
|---|---|---|---|---|---|---|---|---|---|---|
| | | 1 | 2 | 3 | 4 | 1 | 2 | 3 | 4 | 5 |
| Core | Type | a | b | c | d | d | e | a | d | f |
| | Diameter (mm) | 36.5 | 36.5 | 36.5 | 35.7 | 35.7 | 36.5 | 36.5 | 36.5 | 36.5 |
| | Specific gravity | 1.22 | 1.22 | 1.22 | 1.23 | 1.23 | 1.22 | 1.22 | 1.23 | 1.22 |
| | Surface hardness H1 (Shore D) | 48 | 42 | 38 | 35 | 35 | 55 | 48 | 35 | 60 |
| Intermediate layer | Type | C | B | B | C | C | D | C | H | B |
| | Surface hardness H2 (Shore D) | 58 | 55 | 55 | 58 | 58 | 60 | 58 | 65 | 55 |
| | Gage (mm) | 1.6 | 1.6 | 1.6 | 2.0 | 2.0 | 1.6 | 1.6 | 1.6 | 1.6 |
| Hardness difference (H2 − H1) | | 10 | 13 | 17 | 23 | 23 | 5 | 10 | 30 | −5 |
| Cover | Type | F | E | F | F | F | G | H | A | F |
| | Surface hardness H3 (Shore D) | 60 | 58 | 60 | 60 | 60 | 61 | 65 | 53 | 60 |
| | Gage (mm) | 1.5 | 1.5 | 1.5 | 1.5 | 1.5 | 1.5 | 1.5 | 1.5 | 1.5 |
| Hardness difference (H3 − H2) | | 2 | 3 | 5 | 2 | 2 | 1 | 7 | −12 | 5 |
| Type of dimple | | I | II | III | II | IV | II | V | IV | V |
| HS45 #W1 | Carry (m) | 213.0 | 211.0 | 212.0 | 210.0 | 208.0 | 211.5 | 207.0 | 206.5 | 207.5 |
| | Total distance (m) | 230.0 | 228.5 | 228.0 | 227.0 | 222.0 | 227.5 | 220.0 | 221.0 | 222.5 |
| HS35 #W1 | Carry (m) | 148.0 | 149.0 | 149.5 | 150.0 | 147.0 | 145.0 | 146.0 | 147.0 | 144.0 |
| | Total distance (m) | 155.0 | 156.0 | 156.0 | 156.5 | 152.0 | 148.5 | 149.0 | 151.0 | 148.0 |
| Feel | HS45 | S | S | S | S | S | RS | S | RH | H |
| | HS35 | S | S | S | S | S | RH | S | RH | H |

As is apparent from the results in Table 4, the golf ball of Comparative Example 1, which shares the same characteristics as the golf ball of Example 4 within the invention, except for the dimple parameters, has a good feel upon impact, but the Dst index is low on account of a greater number of dimples, resulting in too short a distance. The golf ball of Comparative Example 2 has a core with a high surface hardness and a less hardness difference between the core and the intermediate layer, as a result of which the distance and feel of the ball when hit at a low head speed are poor. The golf ball of Comparative Example 3, aside from its very low Dst index, satisfies the conditions of the invention, which accounts for its good feel but its short distance. The golf ball of Comparative Example 4 has an intermediate layer that is very hard, harder in fact than the cover, as well as a greater overall number of dimples, on account of which the Dst value is too low, resulting in both a poor distance and a poor feel. The golf ball of Comparative Example 5 has a core that is very hard, and indeed harder than the intermediate layer, as well as a low Dst index, resulting in too short a distance and a hard feel.

By contrast, the golf balls of Examples 1 to 4 within the scope of the invention demonstrated a satisfactory distance and a good feel regardless of the club head speed.

Japanese Patent Application No. 136101/1997 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

We claim:

1. A golf ball comprising a solid core, an intermediate layer, and a cover on the surface of which are formed a plurality of dimples, wherein the core has a Shore D hardness at the surface of up to 48, the intermediate layer has a Shore D hardness which is 53 to 60 and at least 8 Shore units higher than the surface hardness of the core, and the cover has a Shore D hardness which is 55 to 65 and higher than the hardness of the intermediate layer, the dimples are of at least two types having different diameters and/or depths, the total number of dimples is 370 to 450, the dimples cover at least 63% of the ball surface, and the index Dst of the overall dimple surface area is at least 4.

2. The golf ball of claim 1 wherein the coefficient $V_0$ of the dimple cross-sectional shape is 0.37 to 0.55.

3. The golf ball of claim 1 wherein the cover is made of a thermoplastic resin composed primarily of an ionomer resin.

* * * * *